US007114883B2

(12) United States Patent
De Baan

(10) Patent No.: US 7,114,883 B2
(45) Date of Patent: Oct. 3, 2006

(54) OFFSHORE FLUID TRANSFER SYSTEM AND METHOD

(75) Inventor: Jacob De Baan, Maassluis (NL)

(73) Assignee: Bluewater Terminal Systems NV, Netherlands Antilles (NL)

( * ) Notice: Subject to any disclaimer, the term of this patent is extended or adjusted under 35 U.S.C. 154(b) by 0 days.

(21) Appl. No.: 10/492,145

(22) PCT Filed: Oct. 10, 2002

(86) PCT No.: PCT/IB02/04418

§ 371 (c)(1),
(2), (4) Date: Apr. 9, 2004

(87) PCT Pub. No.: WO03/033341

PCT Pub. Date: Apr. 24, 2003

(65) Prior Publication Data

US 2005/0002739 A1 Jan. 6, 2005

(30) Foreign Application Priority Data

Oct. 12, 2001 (GB) ..... 0124570.3
Mar. 18, 2002 (GB) ..... 0206353.5

(51) Int. Cl.
*E02D 27/38* (2006.01)
*E02D 29/00* (2006.01)
*B63B 27/00* (2006.01)

(52) U.S. Cl. ..... 405/206; 405/195.1; 405/169; 405/210; 414/137.9

(58) Field of Classification Search ..... 405/195.1, 405/158, 154.1, 169, 206, 208, 210, 168.1; 414/137.9, 138.1, 138.2; 114/230.15–19; 166/338, 346, 352, 355
See application file for complete search history.

(56) References Cited

U.S. PATENT DOCUMENTS 3,286,286 A * 11/1966 Nelson ..... 405/158
3,354,479 A 11/1967 Koppenol et al.
3,442,245 A * 5/1969 Christians et al. ..... 114/230.18
3,783,816 A 1/1974 de Chassy et al.
3,800,547 A * 4/1974 Dutta et al. ..... 405/195.1
3,957,291 A 5/1976 Edling et al.
4,227,830 A * 10/1980 Tuson ..... 405/195.1
4,265,567 A * 5/1981 Nybo ..... 405/224.2
4,323,975 A * 4/1982 Ball ..... 700/302
4,351,260 A * 9/1982 Tuson et al. ..... 114/230.14
4,494,475 A * 1/1985 Eriksen ..... 114/230.14
4,606,294 A * 8/1986 Di Tella et al. ..... 114/230.14
4,669,412 A * 6/1987 Pollack ..... 114/230.14
4,802,431 A * 2/1989 Pollack ..... 114/230.13

(Continued)

FOREIGN PATENT DOCUMENTS

EP 0171136 2/1986

(Continued)

*Primary Examiner*—Jong-Suk (James) Lee
(74) *Attorney, Agent, or Firm*—Fulwider Patton LLP

(57) ABSTRACT

Apparatus (12) for transferring fluid between floating vessels (10, 11) is described, comprising a submerged rigid transfer arm (13) carrying a fluid pipeline (16). The apparatus (12) is provided with thrusters (21) and positioning monitoring means (24). A control system (25) operates the thrusters (21) to move the arm (13) if the position monitoring means (24) shows the arm (13) and the second vessel (11) is outside a given range, to restore the separation to within the range. The pipeline (16) may be located in a tunnel (30) on the arm (13) which opens above the waterline at each end to allow personnel access therein for inspection and maintenance of the pipeline (16).

17 Claims, 4 Drawing Sheets

U.S. PATENT DOCUMENTS

| | | | | |
|---|---|---|---|---|
| 6,354,376 | B1 * | 3/2002 | De Baan | 166/338 |
| 6,517,290 | B1 * | 2/2003 | Poldervaart | 405/224.2 |
| 2003/0226487 | A1 * | 12/2003 | Boatman et al. | 114/230.15 |

FOREIGN PATENT DOCUMENTS

| | | |
|---|---|---|
| GB | 2021781 | 12/1979 |
| GB | 2041578 | 9/1980 |
| GB | 2042466 | 9/1980 |
| GB | 2065307 | 6/1981 |
| GB | 2136375 | 3/1984 |
| GB | 2168939 | 7/1986 |
| GB | 2328196 | 2/1999 |
| GB | 2328197 | 2/1999 |
| GB | 2369607 | 6/2002 |

* cited by examiner 10
11
12
13
14
15
16
17
18
19
20
21
22
23
24
25
26
2
2

OFFSHORE FLUID TRANSFER SYSTEM AND METHOD

CROSS REFERENCES TO RELATED APPLICATIONS

This application is a national stage of PCT/IB02/04418 filed Oct. 10, 2002 and based upon United Kingdom 0124570.3 filed Oct. 12, 2001 and United Kingdom 026353.5 filed Mar. 18, 2002.

FIELD OF THE INVENTION

BACKGROUND OF INVENTION

The present invention relates to apparatus for transferring fluid between two structures, for example two floating vessels, or a fixed offshore structure and a vessel.

Transferring fluid, particularly of a cryogenic product, between two floating vessels, or a fixed offshore structure and a vessel, is a difficult and hazardous operation when performed in open sea. Various systems for transferring fluid have been proposed. For example, UK patent 2328196 describes a system which employs a rigid arm, one end of which is fixed in an articulated fashion to a storage vessel. The other end is supported by means of a flotation tank. A receiving vessel can be moored to this end of the rigid arm to receive fluid transferred from the storage vessel. The fluid transfer system between the rigid arm and the receiving vessel may be handled by articulated rigid pipes, for example of the type described in U.S. Pat. No. 3,556,148.

One disadvantage of such a system is that when the rigid arm is connected to the floating vessel, the action of wind and waves may cause sudden changes in the separation of the arm and vessel. This may impose unacceptable loads on the fluid transfer system or even cause the arm and vessel to collide. Therefore, there is a need to improve the relative motion behaviour between the rigid arm and the recipient vessel.

A further disadvantage is that because the rigid arm is submerged, inspection, maintenance and repair operation are more difficult to carry out.

SUMMARY OF THE INVENTION

Accordingly, in a first aspect, the present invention provides apparatus for transferring fluid between a first structure and a floating vessel, comprising a rigid transfer arm carrying a fluid pipeline for receiving fluid from a first structure, means to attach a first end of the arm to the first structure so as to allow the arm to pivot about at least two axes, loading means located at the second end of the arm and attachable to a floating vessel for transferring fluid from the fluid pipeline to the floating vessel, wherein the apparatus is provided with thrust means operable to rotate the rigid arm relative to the first structure about a substantially vertical axis in use, position monitoring means to monitor the separation of a point on the arm and the floating vessel and a control system operable to actuate the thrust means if the separation is outside a predetermined range, so as to move the arm relative to the floating vessel thereby to restore the separation to within the predetermined range.

In a second aspect, the invention provides apparatus for transferring fluid between first and second floating vessels, comprising a submerged rigid transfer arm, at least one fluid pipeline for transferring fluid between the first and second vessels, the pipeline located in a conduit which is mounted on the arm and which has an opening at each end which is above the water line in use, means to attach a first end of the arm to the first vessel at a position above the water line in use so as to allow the arm to pivot about three axes, loading means located at the second end of the arm and attachable to the second vessel for transferring fluid from the fluid pipeline to the second vessel.

This allows easier access to the attachment means and pipeline for inspection and maintenance.

In this way, the risk of large loads or collisions damaging the transfer system is reduced.

The first structure may itself be another floating vessel or a seabed mounted structure.

The rigid arm may be a space frame construction having a plurality of longitudinal members joined by a plurality of transverse bracing members. In one embodiment, the fluid pipeline is located inside a conduit formed at least in part by one of the longitudinal members. Insulation may be provided around the fluid pipeline.

Advantageously, the conduit is configured to allow access thereinto for inspection and maintenance of the fluid pipeline.

Preferably, apparatus in accordance with the second aspect of the invention is also provided with thrust means operable to rotate the rigid arm relative to the first vessel about a substantially vertical axis in use, position monitoring means to monitor the separation of a point on the arm and the second vessel, and a control system operable to actuate the thrust means if the separation is outside a predetermined range, so as to move the arm relative to the second vessel thereby to restore the separation to within the predetermined range.

The apparatus may usefully comprise mooring means to moor the apparatus to the floating vessel, means to monitor whether the mooring means is attached to the floating vessel and means to automatically disconnect the loading device from the floating vessel if the mooring means becomes detached from the floating vessel.

Similarly, the apparatus may also include mooring means to moor the floating vessel to the structure, means to monitor whether the mooring means is attached to the floating vessel and means to automatically disconnect the loading device from the floating vessel if the mooring means becomes detached from the floating vessel.

In these cases, if the loading device is automatically disconnected from the floating vessel, the control means is preferably operable to actuate the thrust means to move the arm away from the floating vessel.

Preferably, the fluid pipeline is provided with flexible connections allowing it to bridge the pivot points in the apparatus.

In a preferred embodiment, the loading means comprises a cryogenic loading device.

Typically, the apparatus further comprises float means at the second end of the arm, comprising at least one buoyancy device extending both above and below the water line in use.

The float means may comprise two mutually spaced buoyancy devices, each of which extends both above and below the water line in use.

Alternatively, the float means may comprise two mutually spaced submerged buoyancy devices which are connected to each other at,their upper ends and single buoyancy device extending above the water line in use.

In the second aspect of the invention, the rigid arm is typically a space frame construction having a plurality of longitudinal members joined by a plurality of transverse bracing members, forming a peripheral frame within which the conduit is located.

Advantageously, a fender system is provided at the second end of the rigid arm.

In use, the submerged rigid arm will generally be substantially horizontal.

The invention also provides a method of transferring fluid from a first structure to a floating vessel using the apparatus as described above, comprising the steps of: actuating the thrust means to pivot the arm in a first direction about an axis defined by the attachment means relative to the first structure, moving the floating vessel into a position in the vicinity of the first structure, actuating the thrust means to pivot the arm in a second direction opposite to the first direction so as to bring the loading means adjacent the floating vessel, connecting the loading means to the vessel and transferring fluid from the fluid conduit to the floating vessel, disconnecting the loading means from the floating vessel, and actuating the thrust means to pivot the arm in the first direction away from the floating vessel; wherein, while the loading device is connected to the floating vessel, monitoring the separation between a point on the arm and the vessel, and operating the thrust means if the separation is outside a predetermined range so as to move the arm relative to the vessel, thereby to restore the separation to within the predetermined range.

The method may further comprise the step of monitoring whether mooring means on the arm is attached to the floating vessel and in the event of detachment, automatically disconnecting the loading device from the floating vessel.

The method may further comprise the step of monitoring whether mooring means on the structure is attached to the floating vessel and in the event of detachment, automatically disconnecting the loading device from the floating vessel.

In the event of automatic disconnection of the loading device from the floating vessel, the thrust means is preferably operated to move the arm in the first direction away from the floating vessel.

The invention will now be described in detail, by way of example of only, with reference to the accompanying drawings in which:

DETAILED DESCRIPTION OF THE INVENTION

Figures 1, 2:
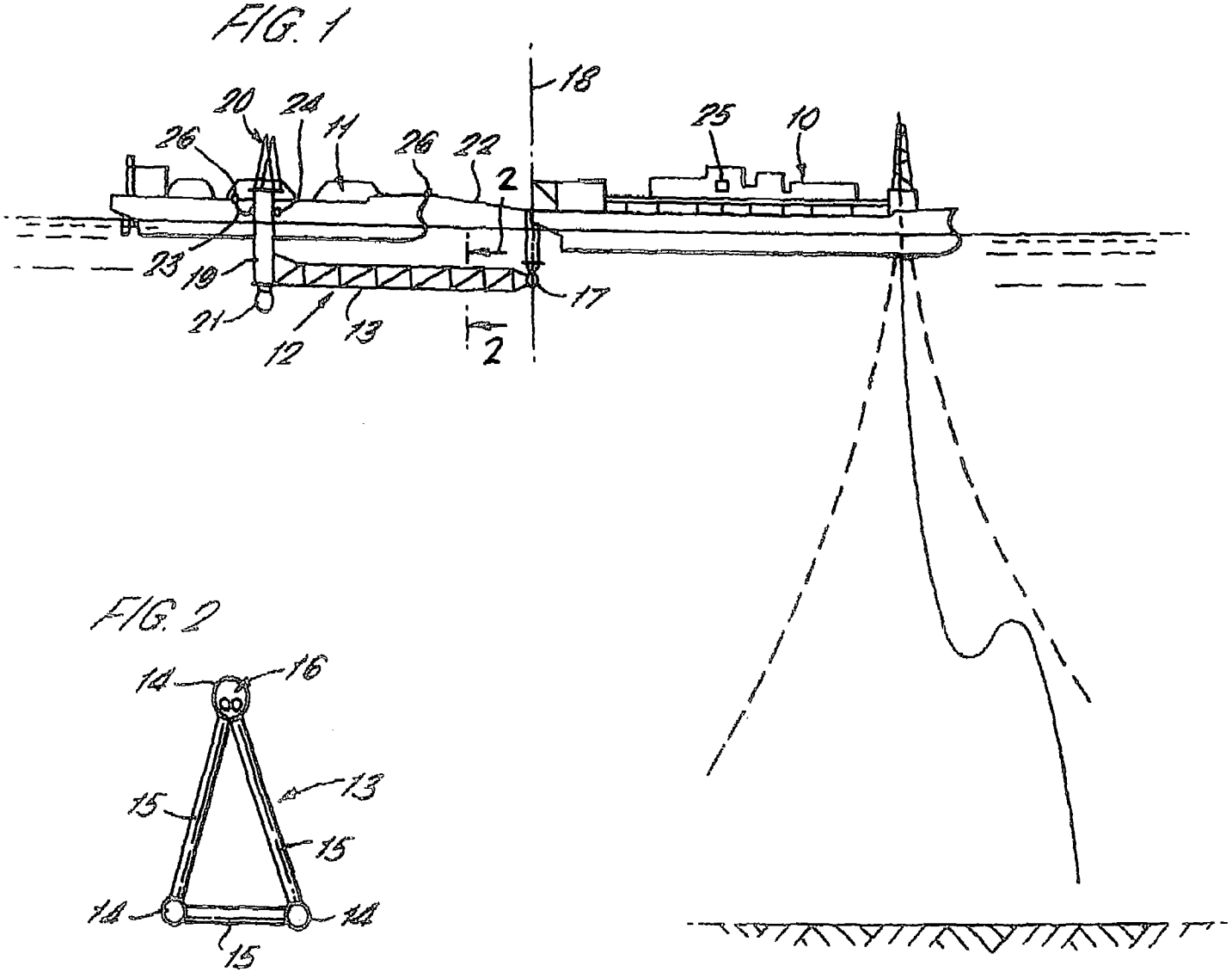
FIG. 1 is a schematic diagram of an apparatus for transferring fluid between two floating vessels in accordance with a first embodiment of the invention.
FIG. 2 is a cross section of the rigid arm shown in FIG. 1 along the line 2—2.

Referring now to FIG. 1, a first floating vessel 10 is shown, which may be a production or storage vessel moored to the seabed by any conventional and appropriate means. A second floating vessel 11, which may be a shuttle tanker for transporting fluid such as liquid natural gas away from the production/storage vessel 10, is located nearby. The transfer apparatus 12 is shown in use, connecting the two vessels 10, 11.

The transfer apparatus 12 consists of a submerged rigid arm 13, typically of space frame type construction. As shown in FIG. 2, the arm 13 may be formed of three longitudinal members 14 arranged in a triangular form and joined by a number of transverse bracing members 15.

Piping 16, for example rigid steel piping, is attached to the arm and carries the fluid being transferred. The piping 16 may be located inside one or more of the longitudinal members 14 and insulation (not shown) may also be provided. This construction protects the piping 16 but also allows the possibility of inspection of the piping 16.

At a first, proximal end of the arm 13, attachment means 17 is provided for attaching the arm 13 to the first vessel 10, preferably at the stern. The attachment means 17 may be constructed in any convenient form which includes articulations allowing the arm 13 to pivot about at least two axes relative to the vessel 10, preferably the vertical axis 18 and the horizontal axis extending perpendicularly into and out of the plane of the paper. The attachment means 17 projects downwardly from the vessel 10 and is dimensioned such that the arm 13 is located underwater at a depth greater than the maximum draught of both the first and second vessels 10, 11.

At the second, distal end of the arm 13, float means 19 is provided which extends upwardly from the arm 13 and projects above the water surface.

A loading device 20, which is preferably a cryogenic loading device of known form, is located on the top of the float means 19. Articulations may be provided to allow the loading device 20 to pivot relative to the float means 19. The loading device 20 is connected to the piping 16 and is connectable to the second vessel 11 to allow transfer of fluid from the piping 16 to the vessel 11. Preferably the loading device 20 is configured to allow fluid pumped from the first vessel 10 to be readily returned to it, for example in the case of an emergency disconnect from the second vessel 11.

The piping 16 is preferably provided with flexible connections such as swivel joints or flexible hoses where necessary to allow it to bridge the various points of articulation in the apparatus 12.

The rigid arm 13 is preferably designed to be of a suitable length such that in use, when the proximal end is attached to the stern of the first vessel 10, its distal end will be adjacent a midship portion of the second vessel 11.

At the lower end of the float member 19, one or more thrusters 21 is located. The or each thruster 21 is powered and controlled from the first vessel 10, for the purpose described further below.

Figure 3:
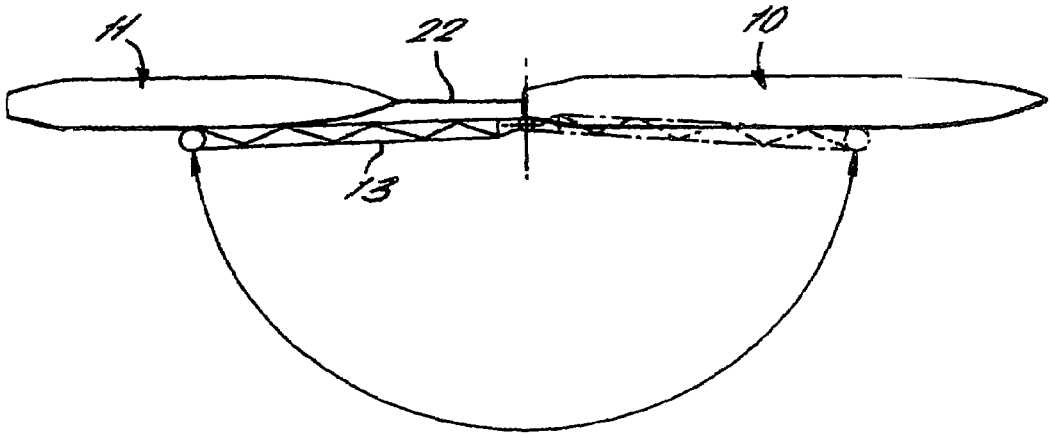
FIG. 3 shows the apparatus of FIG. 1 from above (in solid lines) and when not in use (in dotted lines)

When transfer of fluid to a second vessel 11 is required, the thrusters 21 are used to rotate the arm 13 about the vertical axis 18, for example to rotate it anti-clockwise if viewed from above in FIG. 1, so that it does not obstruct the area around the stern of the first vessel 10. The second vessel 11 can then be manoeuvred into position adjacent the first vessel 10 as shown in FIG. 1. The first and second vessels 10, 11 may now be moored stern to bow by a line 22, for example an elastic line, as shown in FIGS. 1 and 3.

Once the second vessel 11 is in position the thrusters 21 are operated again to rotate the arm 13 in the opposite direction, (clockwise when viewed from above in FIG. 1) to bring the float means 19 and loading device 20 adjacent preferably the midship portion of the second vessel 11. The rigid arm 13 is moored to the vessel 11 by any suitable mooring means, such as mooring lines 23 shown schematically in FIG. 1. The loading device 20 is connected to the appropriate fluid receiving apparatus on board the vessel 11 so that fluid from the piping 16 can be transferred to the second vessel 11. When transfer is complete, the mooring means 23 is disconnected from the vessel 11. The thrusters 21 are then operated to rotate the arm 13 away from the vessel 11, allowing it to leave the area unobstructed.

When the loading device 20 is moored to the vessel 11, the thrusters 21 are also employed to maintain the rigid arm 13 in a substantially fixed position relative to the vessel 11, to ensure that no unacceptable loads are imposed on the loading device 20 and various interconnections between the piping 16 and the vessel 11.

A position monitoring device 24 is mounted on a point on the transfer apparatus 12, for example on the float means 19, to monitor continuously the separation of that point from the hull of the vessel 11. For example, the position monitoring device 24 may act by electronic or visual means. A control system 25 preferably located on the first vessel 10 receives information from the position monitoring device 24. If the transfer apparatus 12 and the vessel 11 move towards or away from one another so that their separation is no longer within an acceptable range, the control system 25 responds by operating the thrusters 21 to move the transfer apparatus 12 in an appropriate direction so as to restore the transfer apparatus 12 and the vessel 11 to within an acceptable separation range. In this way, any relative movement due to the action of wind and waves can be accommodated to avoid the risk of damaging the transfer apparatus 12 and/or the vessel 11.

Preferably, the apparatus also comprises means 26 to monitor whether the mooring means 23 is actually attached to the vessel 11 and/or whether the line 22 is attached to the vessel 11. If the mooring means 23 and/or line 22 become accidentally detached from the vessel 11, the control system 25 operates to automatically disconnect the loading device 20 from the vessel 11, to avoid any damage to the loading device 20 which might occur if the separation of the vessel 11 and the transfer apparatus 12 changes significantly due to detachment of the mooring means 22, 23.

Furthermore, if the control system 25 operates in this way to disconnect the loading device 20 from the vessel 11, it also operates the thrusters 21 to move the rigid arm 13 well away from the vessel 11, to avoid the danger of collision.

In this way, the safety of the transfer operation is improved and the service life of the transfer apparatus 12 increased.

When the transfer apparatus 12 is not being used, it may have its distal end secured to the first vessel 10. For example, if the transfer apparatus 12 is attached to the stern of the vessel 10, it can be pivoted back round so that its distal end can be secured to the vessel 10 towards the bow region as shown in dotted lines in FIG. 3. In this way the transfer apparatus 12 is able to withstand extreme weather conditions which may exceed its design parameters. It also allows inspection, repair and maintenance to be carried out more easily.

Although the invention has been described with reference to transferring fluid between two floating vessels it will be appreciated that it is also applicable to transfer between a fixed structure and a vessel.

Figure 4:
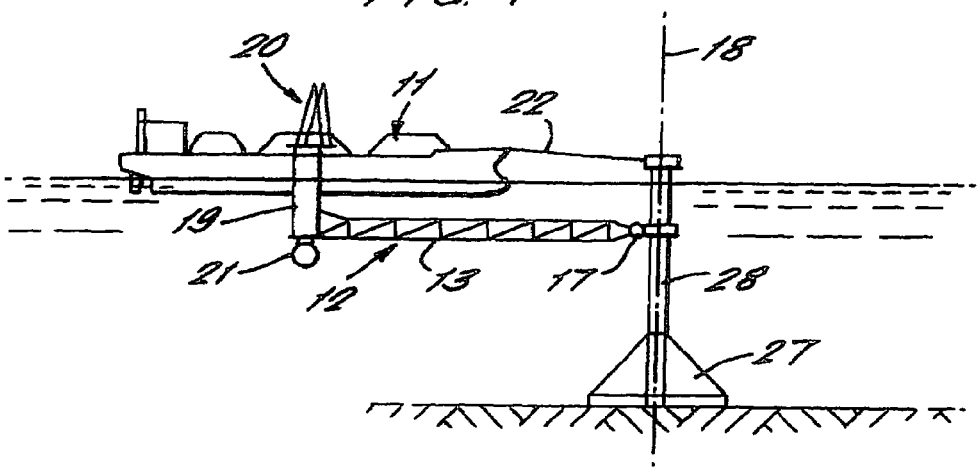
FIG. 4 is a schematic diagram of an apparatus for transferring fluid between a seabed pipeline and a vessel in accordance with a second embodiment of the invention.

For example, as shown in FIG. 4 the fixed structure may comprise a base 27 mounted on the seabed from which a column 28 rises to above the surface of the water. The base 27 may be a well-head, or connected by a seabed pipeline to a well-head or onshore plant. The arm 13 is attached to the column 28 by articulated attachment means 17 and the vessel 11 may be moored to the column 28 by a line 22. The other features are the same as in the first embodiment.

Figure 5:
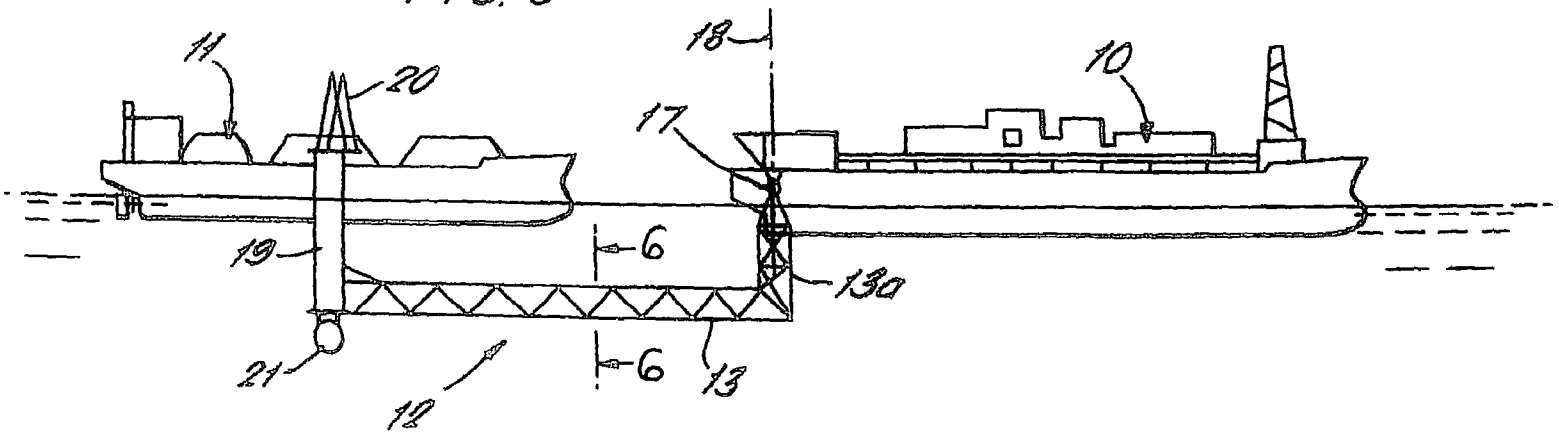
FIG. 5 is a schematic diagram of an apparatus for transferring fluid between two floating vessels in accordance with a third embodiment of the invention.

Another embodiment of transfer apparatus 12 is shown in FIG. 5 for transfer between two floating vessels 10, 11. This is generally similar to the first embodiment of FIG. 1. However, in this case, at its first, proximal end the arm 13 includes an upward projection 13*a* which extends up above the waterline and is connected to the first vessel 10 by attachment means 17. The attachment means 17 may be constructed in any convenient form which includes articulations allowing the arm 13 to pivot about three axes relative to the vessel 10, preferably the vertical axis 18, a horizontal axis extending into and out of the plane of the paper and a horizontal axis parallel with the plane of the paper.

The upward projection 13*a* and the attachment means 17 are sized such that the horizontal portion of the arm 13 is located underwater at a depth greater than the maximum draught of both the first and second vessels 10, 11. This construction allows easier access to the attachment means 17 for inspection, maintenance and repair.

Figure 7:
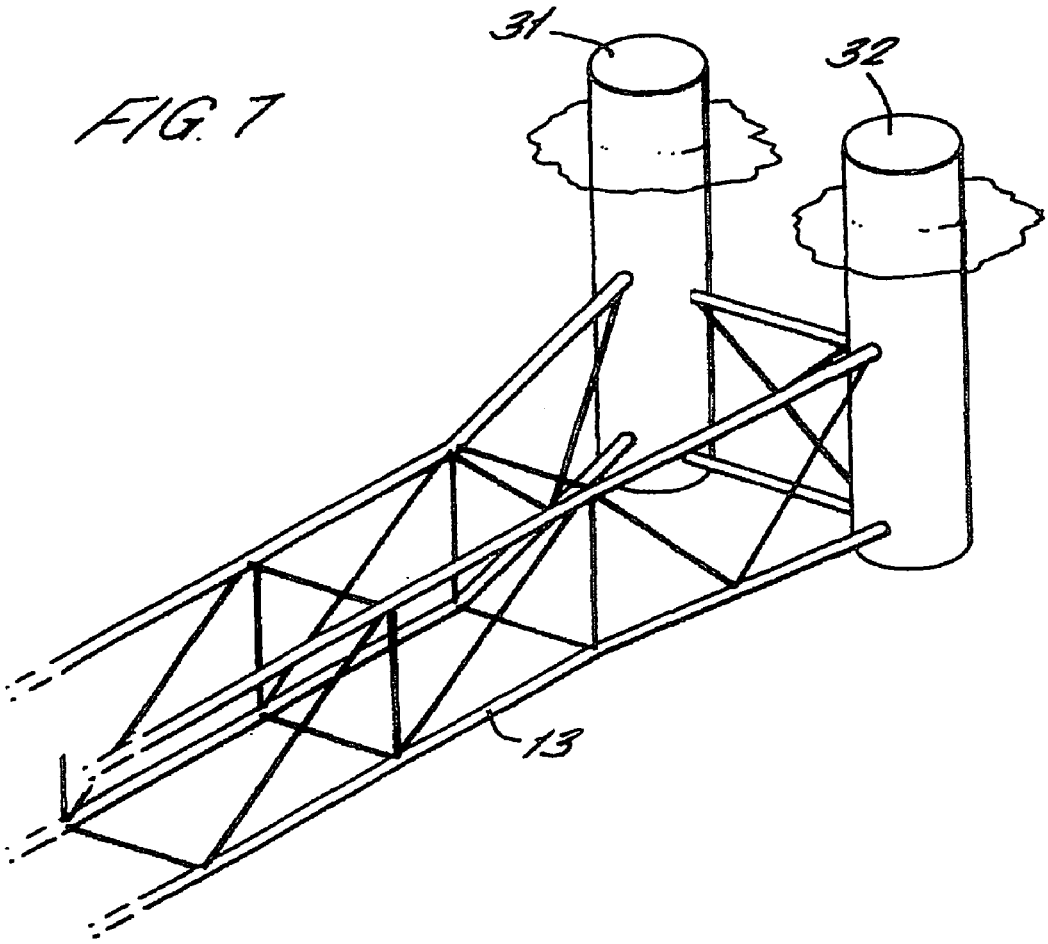
FIGS. 7 and 8 are schematic diagrams of two embodiments of the float means at the distal end of the transfer apparatus.
Figure 8:
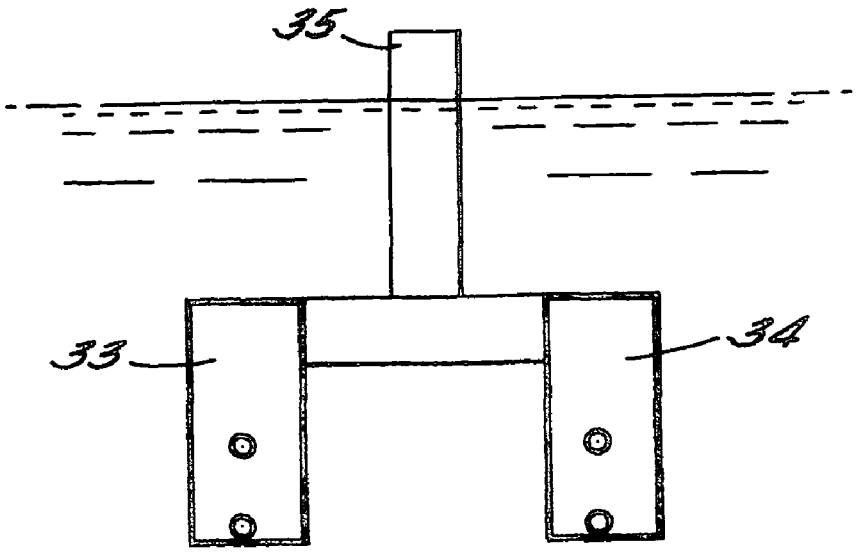

In this embodiment, the float means 19 at the distal end of the arm 13 preferably incorporates at least one and preferably two buoyancy devices 31, 32 as shown in FIG. 7. In this example, the buoyancy devices 31, 32 are substantially cylindrical members which are mutually spaced and project both above and below the waterline. Alternatively, as shown in FIG. 8, there may be two mutually spaced buoyancy devices 33, 34 below the waterline which are joined at their upper ends to create a single buoyancy device 35 which projects up above the waterline. Since the attachment means 17 provides 3 degrees of freedom for the transfer apparatus 12, these configurations of buoyancy devices provide the entire assembly with a natural stability. It will be appreciated that buoyancy means as shown in FIGS. 7 and 8 could also be used in the embodiments of FIGS. 1 and 4.

Figure 6:
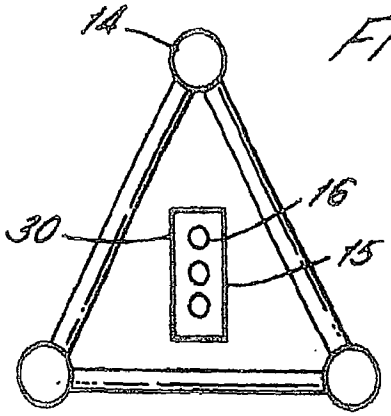
FIG. 6 is a cross section of the rigid arm shown in FIG. 5 along the line 6—6.

Another feature of the third embodiment is that the piping 16 is located inside a conduit or tunnel 30 which extends the length of the arm 13, for example within the space frame construction, as seen in FIG. 6. The tunnel 30 has an opening above the waterline at the proximal end of the transfer apparatus 12 and extends continuously to another opening above the waterline at the distal end. The tunnel 30 and openings are designed to permit personnel entry and movement therealong. In this way the entire length of pipeline 16 is accessible in a substantially dry environment for inspection, repair and maintenance, avoiding the need for divers.

It will be appreciated that the feature of the upward projection 13*a* and location of the attachment means 17 above the waterline, and the feature of the tunnel 30 could also be used in the first and second embodiments of transfer apparatus described above.

As in the other embodiments, the piping 16 is preferably provided with flexible connections such as swivel joints or flexible hoses where necessary to allow it to bridge the various points of articulation in the apparatus 12.

It will be appreciated that the invention provides an improved fluid transfer system for use in an offshore environment and that other modifications and variations to the specific embodiments described are also possible.

The invention claimed is:

1. Apparatus for transferring fluid between a first structure and a floating vessel, comprising:

a submerged rigid transfer arm carrying a fluid pipeline for receiving fluid from a first structure, means to attach a first end of the arm to the first structure so as to allow the arm to pivot about at least two axes, loading means located at the second end of the arm and attachable to a floating vessel for transferring fluid from the fluid pipeline to the floating vessel, wherein the apparatus is provided with thrust means operable to rotate the rigid arm relative to the first structure about a substantially vertical axis in use, position monitoring means to monitor the separation of a point on the arm and the floating vessel and a control system operable to actuate the thrust means if the separation is outside a predetermined range, so as to move the arm relative to the floating vessel thereby to restore the separation to within the predetermined range;

mooring means to moor the floating vessel to the first structure means to monitor whether the mooring means is attached to the floating vessel and means to automatically disconnect the loading device from the floating vessel if the mooring means becomes detached from the floating vessel.

2. Apparatus as claimed in claim 1, wherein the first structure is a floating vessel.

3. Apparatus as claimed in claim 1, wherein the first structure is a seabed mounted structure.

4. Apparatus as claimed in claim 1, wherein the rigid arm is a space frame construction having a plurality of longitudinal members joined by a plurality of transverse bracing members.

5. Apparatus as claimed in claim 1, wherein the fluid pipeline is located inside a conduit formed at least in part by one of the longitudinal members.

6. Apparatus as claimed in claim 5, wherein insulation is provided around the fluid pipeline.

7. Apparatus as claimed in claim 6, wherein the rigid arm is a space frame construction having a plurality of longitudinal members joined by a plurality of transverse bracing members, forming a peripheral frame within which the conduit is located.

8. Apparatus as claimed in claim 1, further comprising mooring means to moor the apparatus to the floating vessel, means to monitor whether the mooring means is attached to the floating vessel and means to automatically disconnect the loading device from the floating vessel if the mooring means becomes detached from the floating vessel.

9. Apparatus as claimed in claim 8, wherein if the loading device is automatically disconnected from the floating vessel, the control means is operable to actuate the thrust means to move the arm away from the floating vessel.

10. Apparatus as claimed in claim 1, further comprising mooring means to moor the floating vessel to the first structure, means to monitor whether the mooring means is attached to the floating vessel and means to automatically disconnect the loading device from the floating vessel if the mooring means becomes detached from the floating vessel.

11. Apparatus as claimed in claim 1, wherein the fluid pipeline is provided with flexible connections allowing it to bridge the pivot points in the apparatus.

12. Apparatus as claimed in claim 1, wherein the loading means comprises a cryogenic loading device.

13. Apparatus as claimed in claim 1, further comprising float means at the second end of the arm, comprising at least one buoyancy device extending both above and below the water line in use.

14. Apparatus as claimed in claim 13, wherein the float means comprises two mutually spaced submerged buoyancy devices which are connected to each other at their upper ends and single buoyancy device extending above the water line in use.

15. Apparatus as claimed in claim 13, wherein the rigid arm is a space frame construction having a plurality of longitudinal members joined by a plurality of transverse bracing members, forming a peripheral frame within which the conduit is located.

16. Apparatus as claimed in claim 1, further comprising a fender system at the second end of the rigid arm.

17. Apparatus as claimed in claim 1, wherein, in use the submerged rigid arm is substantially horizontal.

* * * * *